United States Patent [19]

Davis

[11] 4,276,790

[45] Jul. 7, 1981

[54] OPEN-ENDED WRENCH HAVING RATCHETING ACTION

[76] Inventor: Brian L. Davis, 610 Newbury, Ripon, Wis. 54971

[21] Appl. No.: 39,644

[22] Filed: May 16, 1979

[51] Int. Cl.[3] ..... B25B 13/28

[52] U.S. Cl. ..... 81/111

[58] Field of Search ..... 81/99, 111

[56] References Cited

U.S. PATENT DOCUMENTS

| | | | |
|---|---|---|---|
| 743,019 | 11/1903 | Nelson | 81/111 |
| 749,134 | 1/1904 | Hyman | 81/111 |
| 1,015,504 | 1/1912 | Meyer | 81/111 |
| 1,068,771 | 7/1913 | Holmes | 81/99 |
| 2,618,996 | 11/1952 | Hogan | 81/111 |
| 3,309,949 | 3/1967 | Neff | 81/111 |

*Primary Examiner*—James G. Smith

*Attorney, Agent, or Firm*—Andrus, Sceales, Starke & Sawall

[57] ABSTRACT

A ratcheting open-ended wrench includes a fixed jaw and a pivoted jaw arranged in relationship to each other to define an in-line insertion opening aligned with the operating handle portion in accordance with a conventional open-ended wrench. The fixed and pivoted jaws are formed with cooperating notched faces creating a multiple pointed configuration equivalent to a socket or closed-end wrench for mating with a hex-type head in different angular orientation. The fixed and pivoted jaw include a force transmission arm and recess such that the turning force is transmitted from the fixed jaw directly to the pivoted jaw. The pivoted jaw has a pivoted connection to one side of the handle and extends across the end of the handle and then outwardly to locate the fulcrum permitting application of closing forces in one direction and the ratcheting release on the reverse stroke.

8 Claims, 4 Drawing Figures

OPEN-ENDED WRENCH HAVING RATCHETING ACTION

BACKGROUND OF THE INVENTION

The present invention relates to an open-ended wrench having a ratcheting action to permit application of the wrench in confined spacements.

Open-ended wrenches are often required for application to a nut or bolt head in a confined environment. Thus the open-ended wrench can be extended inwardly through a relatively small opening in alignment with the nut or bolt head for tightening or loosening of the corresponding elements. In location with a turning space of about 30 degrees, the open-ended wrench may be advantageously applied by merely reversing of the wrench position with each turn. In such systems, of course, the wrench must be inserted, turned, removed, reinserted and so forth. The action is rather time consuming and may be rather difficult if the element is not turned precisely the proper amount.

Closed end type wrenches have been developed into socket form with a ratcheting attachment provided. This permits the application of the unit directly to the element and, with a convenient reciprocating rotation of the operating handle, the nut or bolt is turned. Although various other ratcheting wrenches have also been suggested they generally operate on the basic principle of a pipe wrench more than an open-ended wrench. For example, U.S. Pat. No. 1,635,930 discloses a wrench having a pivoted pawl or jaw and a fixed jaw defining an offset wrench opening. The jaws are angularly offset to the wrench arm and provided with serrated faces generally in the nature of the usual pipe wrench, vice-grip or the like. More recently, U.S. Pat. No. 2,655,064 which issued Oct. 13, 1953, discloses a ratcheting open-jawed wrench having an encircling moveable jaw with a bill-like portion which is adapted to wrap about the end of an arm of a wrench member to define a ratcheting wrench. The bill-like portion is formed with a plurality of offset portions to permit engagement with a hex-shaped nut, bolt head or the like. The offset bill-like construction requires that the unit be inserted more or less to the side of the head rather than directly thereto as with a conventional open-ended wrench. A somewhat similar device is shown in the early U.S. Pat. No. 1,072,090 which issued Sept. 12, 1913 and in which an angularly offset opening includes a multiple face fixed jaw and multiple face moveable jaw provided for similar functioning and operation. Although such prior art devices have been suggested, they do not function to duplicate the function of an open-ended wrench and generally will not provide the various features of an open-ended wrench. Thus, the prior art does not allow the direct in-line mounting and insertion, nor does it provide for the convenient reverse positioning of the tool for turning within a limited environment. In addition the prior art essentially uses the principle of a pawl attached to a torque converting jaw by a pin connection, with the stress applied to the pin member during the application of the closing or loading of the unit to rotate the work. The forces are generally transmitted from the fixed jaw to the pivot element and therethrough to the moveable jaw.

The prior art can therefore be appropriately characterized as having various characteristics of a pipe wrench, namely, the offset handle and opening the serrated gripping surface for gripping of a member, force transmission through the work and a connecting pin, or the like.

SUMMARY OF THE INVENTION

The present invention is particularly directed to an open-ended wrench having a ratcheting action in which the characteristics and function of an open-ended wrench are retained. Generally, in accordance with the present invention, the wrench is formed with a fixed jaw and with a pivoted jaw arranged in relationship to each other to define a substantially in-line opening with the operating handle portion, preferably in accordance with a conventional open-ended wrench. In addition, the fixed and pivoted jaws are formed with cooperating multi-faceted flat faces of the jaws forming a multiple pointed configuration equivalent to a socket-type configuration to mate with a hex-type head in different angular orientation. The flat faces or surfaces are properly shaped and positioned in relationship to the pivoted jaw fulcrum permitting application of closing forces in one direction and a ratcheting release on the reverse stroke. By employing of the conventional open-ended wrench configuration and the special hex-type jaw face, the wrench can function as an open-ended wrench thus permitting tightening through an angle approximately 30° and ratcheting return of the wrench to align the next section with the drive head, thus producing the desired turning action within a confined space. Further, in accordance with another feature of an optimum structure of the present invention, the overlapping and nesting relationship of the fixed and pivoted jaw includes a force transmission connection means from the fixed jaw to the pivoted jaw such that during the tightening action or force, the force is transmitted from the fixed jaw directly to the pivoted jaw rather than transmitting of such force through the pivot pin. In a particular structure which may advantageously be incorporated in the wrench of the present invention, the fixed jaw is integrally formed with and to one side of the handle, with a machined grooved surface in one face, with a sufficient base metal portion to strengthen the wrench head. The grooved surface including a bearing opening or recess which opens outwardly through a flared portion into an enlarged pivot recess across the head portion of the handle. The flared opening defines a flat wall joining with an arcuate well adjacent the jaw opening and the extending between the two recesses. The ratchet jaw is provided with a circular journal complementing the circular opening and a force recess complementing the arcuate well. The circular journal is pinned within the bearing opening with the arcuate well and force recess mating when the pivoted jaw is in the closed position.

The inner surface of the fixed jaw and the pivoted jaw are preferably formed with eight points equicircumferentially spaced in the same configuration as a twelve point open-ended socket, with the entrance opening aligned with the handle and encompassing the four missing points. The mating wall and force recess are in full engagement with the pivoted jaw in the totally closed positioned and form a grip upon a hex-type head to simulate an integral open-ended wrench.

The pivoted jaw is biased to the closed position by a suitable spring means located between back wall of the recess and the backside of the pivoted jaw. The spring need only be of a minimal strength because it serves only to position the jaw to the closed position prior to application of the turning force.

In operation the wrench is forced into the appropriate opening and over the nut, with the ratchet jaw pivoting outwardly during movement onto the nut. The fixed jaw is preferably provided in accordance with one separate unique feature with a unique inwardly set guide and stop wall means to prevent the movement of the wrench inwardly beyond the desired position relative to the wrench jaw. The guide wall particularly bears on the drive head during the return or ratcheting turn and prevents the head from rotating. The ratcheting wrench of the present invention may thus be moved onto a hex-shaped head and grips the head at the plurality of faces and corners to provide a firm gripping and holding action in the manner of a conventional open-ended wrench. When force is applied from the wrench to the nut, the force is transmitted from the fixed head to the nut and also from the fixed head directly to the pivoted jaw through the mating projection wall and force groove or recess of the pivoted jaw to an essentially solid wrench in all operating positions.

The present invention thus provides a true open-ended ratcheting wrench having the functional characteristic and operation as a conventional open-ended wrench with the addition of a ratcheting action.

DESCRIPTION OF THE DRAWING FIGURES

The drawing furnished herewith illustrates a preferred construction of the present invention in which the above advantages and features are clearly disclosed as well as others which will be readily understood from the following description.

DESCRIPTION OF ILLUSTRATED EMBODIMENT

Figure 1:
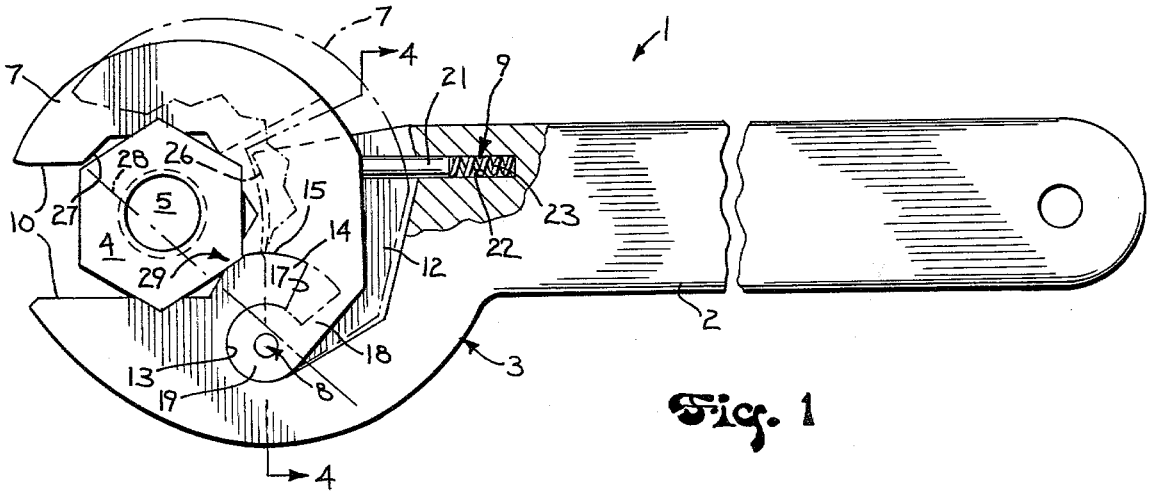
FIG. 1 is a plan view of a wrench, illustrating one embodiment of the present invention, and applied to application of a nut onto a stud.
Figure 2:
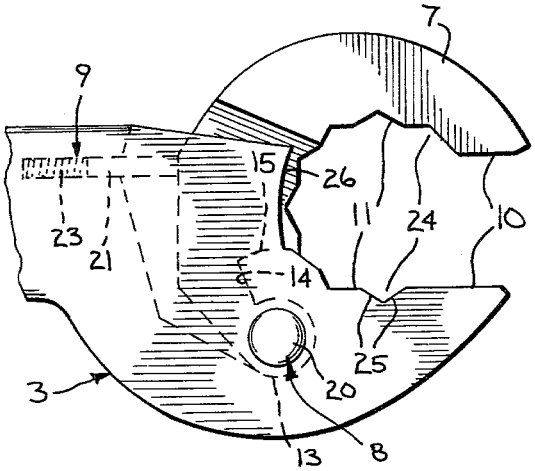
FIG. 2 is a view showing the backside of the wrench as shown in FIG. 1.
Figure 3:
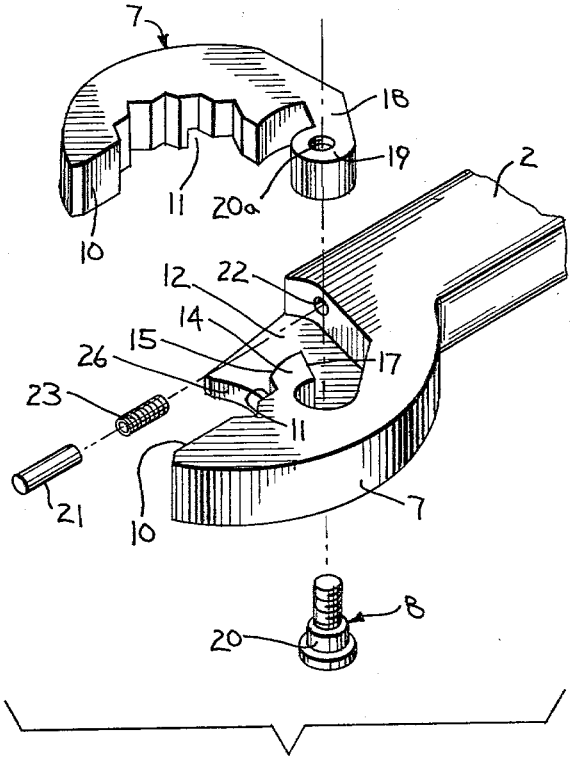
FIG. 3 is an exploded view of the ratcheting wrench shown in FIGS. 1 and 2.
Figure 4:
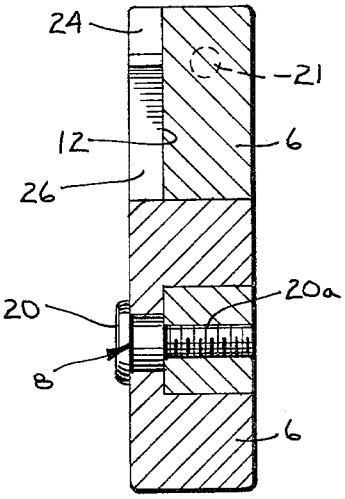
FIG. 4 is a sectional view taken generally on line 4—4 of FIG. 1.

Referring particularly to FIG. 1, an open-ended wrench 1, constructed in accordance with the teaching of the present invention, is shown including an elongated generally rectangular handle 2 with an open-ended wrench head 3 with an opening to receive a hex-shaped drive head such as a nut 4. The wrench 1 turns nut 4 on the stud 5 by pivoting of the wrench. The wrench head 3 generally includes a fixed jaw 6 and an interconnected pivotally mounted pivoted jaw 7 interconnected by a pin connection 8. A spring means 9, provided between handle 2 and backside of the pivoted jaw 7, urges the jaw 7 to a closed position, shown in FIG. 1. Jaws 6 and 7 are generally arcuately shaped and define an entrance opening 10 to an eight-pointed head opening 11 defined by the inner surface of the fixed jaw 6 and the pivoted jaw 7. The entrance opening 10 is aligned with the handle 2 in the manner of a conventional open-ended wrench. The spring-loaded pivoted jaw 7 permits the direct movement of the wrench 1 onto an aligned nut 4, and after assembly thereon permits the turning of the nut with a conventional ratcheting function. The jaws 6 and 7 are interrelated to each other and especially constructed to provide a relatively direct force transmission from the fixed jaw 6 to the pivoted jaw 7 in the load turning direction. Thus, in turning in the direction from the fixed jaw 6 to the pivoted jaw, the turning forces are transmitted directly to nut 4 from the interconnected jaws 6 and 7. Turning in the opposite direction permits the pivoted jaw to pivot about its pivot connection 8 and allows the wrench 1 to turn without movement of the nut.

More particularly, the fixed jaw 6 is formed as an integral portion of the head end 3 of the wrench handle 2 with the jaws extending laterally and forwardly to define the one side of the nut opening 11. The integral jaw 6 thus has a generally circular outer wall terminating at the outermost end in a flat inwardly extending wall, forming the one side of the entrance opening 10. The end face of the fixed jaw is provided with a machined groove 12 including a cylindrical bearing opening 13 which is located to the one side of the head opening 11 and the handle 2. Opening 13 is also located inwardly towards the handle 2 from the center of the head opening 11. In the illustrated embodiment, the center of opening 13 is aligned with the innermost portion of the head opening 11. The machined groove 12 extends from the opening 13 across the head end of the handle with a generally flared connecting opening to a removed portion extending outwardly from the handle to the opening 11. The grooved portion includes an encircling force transmitting member or arm 14 which encircles the inner side of the bearing opening. Arm 14 has a circular wall 15 with the center on the axis of the pivot connection 8. The terminating outer end of the member 14 is preferably a planar or flat wall 17.

The pivoted jaw 7 includes a pivot arm 18 having a cylindrical bearing portion 19 mating with the cylindrical pivot opening 13. The pivoted jaw 7 is journaled in opening 13 by a shoulder bolt 20 extending through an opening in jaw 6 and threaded into the jaw 7 as at 20*a* to turn therewith. Jaw 7 includes a lateral flared extension passing through the flared opening portion of the machined groove 12 to a body portion which extends across the head of the wrench handle and then outwardly to form the opposite side of opening 10. The flared extension of jaw 7 is smaller than that of the corresponding flared portion of the groove 12 to permit pivoting movement of jaw 7. The extension includes a flat wall corresponding to and aligned with flat wall 17 of the member 14 and the outer body portion of the jaw 7, which includes a wall portion forming the base or inner portion of opening 10 and which projects outwardly about the arcuate wall arm 14. Jaw 7 is generally arcuately shaped with the circular base-opening portion forming a complementing recess engaging and moving on the arcuate bearing wall 15 of the transmitting arm 14. The outer portion of jaw 7 projects outwardly to form the opposite side of openings 10 and 11 and includes a flat wall forming part of 10 and a specially shaped inner wall forming part of opening 11.

The pivoted jaw 7 is biased outwardly to an outmost position with the arcuate recess mating with the complementing arm member 14 of the fixed jaw 6 by the spring means 9. In the illustrated embodiment, spring means 9 includes a pin 21 journaled within a suitable spring opening 22 in the grooved wall of the head end of the handle. A coil spring 23 within opening 22 urges the pin 21 outwardly into sliding bearing engagement with the backside of the pivoted jaw 7. The spring loading force is sufficient to bias the jaw 7 to the closed position, shown in FIG. 1.

Spring loaded pin 21 thus positions the pivoted jaw 7 engaging nut 4 while pivoting of the jaw 7 to enlarge opening 10 during the insertion of the wrench onto the nut 4 for example, as shown in phantom FIG. 1. The spring 23 may be of minimal strength because it merely provides a means of initially locating the jaw.

The surface configuration of the inner head opening is constructed to define a multiple faceted opening essentially similar to the notched configuration of a closed end or box wrench. The outermost portion is removed to define the opening 10 as in an open-ended wrench. The fixed jaw 6 and the pivoted jaw 7 are preferably formed in accordance with conventional twelve-point box wrench to mate with a conventional drive head such as a hex-shaped bolt or nut, and permits the wrench to operate in a range of a 30° angle in accordance with conventional practice of a wrench. In particular, the notches 24 are V-shaped with angulated flat sidewalls 25 forming a corner or point as in a conventional hex-shaped nut or bolt. The notches are selected and positioned in relation to each as in a twelve point box wrench such that first and second meshing groups of the notches 24 form a first set of six notches which mate a nut in one position, as shown in FIG. 1, and a second group offset from the first group by 30° and which mate with a nut in a corresponding second position, as shown in FIG. 1. The single pawl thus acts as a double acting unit which can contact a conventional fixed faced nut in anyone of two positions. The fulcrum 8 of the jaw 7 is located relative to the opening and the force transmitting arm member 14 and mating recess to establish proper and effective positioning of head 3 on the nut 4, whereby the jaws 6 and 7 firmly grip the nut in the tightening stroke while allowing the free pivoting of the jaw 7 on the reverse stroke.

The base portion of the fixed jaw 6 and particularly the grooved portion is formed with an outermost curved guide and stop wall 26 which is spaced slightly inwardly of the head opening 11, with the pivoted jaw 7 in the closed position. The curved end wall 26 acts as a stop during the introduction of the wrench and as a guiding bearing wall during the ratcheting result movement of the wrench. Thus, the jaw 7 pivots rearwardly or toward the handle as the wrench 1 is moved onto the nut 4 until the nut engages the curved wall to ensure proper location and positioning of the wrench on the nut. The wall 26 thus prevents excessive movement into the nut such that the jaw 7 may move into turning engagement. The guide wall is preferably a smooth curved wall which moves into engagement with the nut as the pivoted jaw pivots from the closed position during the reset or ratcheting movement of the jaw. In the absence of a guide wall means, the nut could move into the notched area of the pivoted jaw. The nut would then tend to turn back with the resetting movement of the wrench 1. The guide wall thus serves to minimize the tendency for the nut to turn with the wrench during the ratcheting movement, and thus contributes to creation of reliable operation. The continuous surface formed by the base of the machined portion maintains an integral head structure which significantly strengthens the connection of the fixed jaw and handle, as well as the support of the curved guide wall.

The present inventor has found that for an optimum construction, location and configuration of the several notches with respect to the pivot connection 8 and with respect to each other is significant so as to properly transmit closing torque or forces and to retain proper ratcheting movement without reverse turning of the drive head or jamming of the head within the wrench jaws. In particular, the first and second head opening notches 24 in the ratcheting jaw adjacent to the entrance opening are constructed with the turning torque faces or walls 27 located such that a right angle from the outer end of the face wall defines an imaginary or reference line 28 passing to the pivot jaw side of the pivot connection 8. These two faces are thus the two outermost surfaces employed in the two alternate positions of the drive head 4. If the reference line 28 is not properly located with respect to the connection or fulcrum, the ratchet 7 may move relative to the center point. In particular, if the line 28 extends to the opposite side of the pivot center or connection 8, the ratchet jaw 7 would tend to open and move around the surface of the drive head 4 during the tightening torque or turning action of the wrench and turn on head 4. These faces 27 are also preferably formed as full length surfaces to provide maximum force transmission to the drive head 4 in the closing position.

In addition, the inventor has found that with the closed hex-head type opening 11, some of the notch faces may tend to hang up on the drive head 4 and even turn the drive head 4 in reverse direction during the reset ratcheting motion. Such might be particularly encountered in practical implementation because of required manufacturing tolerances or the like. This interference is eliminated by slight modification of the angular orientation and/or placement thereof. For example, the outermost drive jaw face 27 may be moved outwardly and/or angularly oriented outwardly with respect to the apex of the first notch 24 such that during the ratcheting action the surface moves outwardly to prevent any interfering engagement between the nut and the ratchet jaw 7 during the ratcheting movement. In addition, it may be advisable to round certain of the notch surfaces to maintain smooth ratcheting action between the various surfaces. For example, the notch formed between the fixed jaw 6 and the pivoted jaw 7 as at 29 is preferably dropped or moved inwardly slightly to positively prevent any jamming at that point. For example, an offset on the order of 5,000 of an inch in a wrench for $1\frac{1}{8}$ inch nut may have been found to produce an improved action. Similarly the immediately adjacent outer point or apex of the fixed jaw 6 may be rounded to provide an improved free moving turning of the nut for movement of the edge over the nut. Thus, in $1\frac{1}{8}$ inch wrench, rounding off with a radius of approximately 0.650 inches to a distance of about 0.068 inches to the opposite side of the outer apex provided an improved functioning and smooth operation. The above and other similar placement and angular adjustments to the surfaces in relationship to each other may be readily provided by those skilled in the art in the usual design of any given wrench based on the present invention in order to provide any necessary adjustment and compensation.

In use, the wrench head 3 is capable of entering into engagement with the nut 4 with a straight in-line motion of the wrench 1, with the stop wall 26 preventing the nut from catching onto the bottom flats. The operator, after engagement, pivots the handle back and forth in a manner of a conventional ratchet permitting use in a minimal space. The closed jaws 6 and 7 forms a solid wrench structure as a result of the mating projection or arm 14 and recess in the fixed and movable jaws. The multiple gripping of the nut 4 on its several corners, as in a box-wrench, minimizes the possibility that the nut will be damaged during the turning of the nut. The direct transmission of the forces between the jaws permits high torque application without destruction of the wrench.

The wrench has been shown in a preferred best mode construction and various modifications thereof can of course be made. For example, it is not essential that a hex-head be employed if the advantages of turning action within a 30° turning radius is not considered necessary. Similarly the location of the fulcrum point and the interengaging surfaces can be varied as long as the relationship in accordance with the teaching of the present invention is maintained. Similarly, the handle construction is shown in the preferred conventional continuous in-line relationship to the opening with the integral head extension in the manner of a conventional open-ended wrench which permits the effective turning in a limited radius. If for any reason such feature is not desired the opening can be maintained with respect to the base portion of the opening and head attachment with the handle structure offset or bent through a suitable interconnecting means. Such a construction would of course not obtain all of the many features of the present invention as described above. Further, with the hex-head opening, the wrench must be inserted essentially with the head in the principle plane of the drive-head in order to maintain a full mating of the drive head with the hex-shaped opening. If, for any reason, it is desired to have a more universal type of wrench and which may be inserted with the handle offset from the plane of the head, a laterally extending pivot joint could be provided to permit angular offset of the handle 2 relative to the head 3 from the common plane through the handle and head. These and other similar modifications will be readily apparent to those skilled in the art and consequently no further discussion is given herein.

The present invention thus provides an open-ended wrench with a ratcheting action which can be used in place of a conventional open-ended wrench.

I claim:

1. A ratcheting open-ended wrench for turning of a drive head such as a nut or bolt head, comprising an operating handle having a fixed jaw fixedly secured to one end thereof, said fixed jaw extending outwardly and laterally to define one side of a drive head opening, a pivoted jaw including a base portion pivotally connected to the fixed jaw in alignment with the fixed jaw and extending laterally across the end of the handle and extending outwardly from said base portion to the opposite side of the handle to define the base portion and opposite side of the drive head opening, said pivoted jaw being spaced from said fixed jaw to define an entrance to said drive head opening and said fixed and pivoted jaws having notched surfaces including at least one notch in each of said fixed jaw and said base portion and said opposite side of said pivoted jaw and complementing a correspondingly shaped drive head, whereby said drive head opening is oriented with said entrance essentially aligned with the operating handle and said pivot position is located to one side of said drive head opening, each of said fixed jaw and said movable pivoted jaw include a plurality of substantially V-shaped adjacent notches, each notch of which consists of a pair of similar planar surfaces and defining a first plurality of interrelated equicircumferentially spaced notches and a second identical plurality of interrelated equicircumferentially spaced notches interposed in offset orientation with respect to each other to define an opening in accordance with a six-sided drive head whereby the drive head is adapted to be positioned in two alternate positions within the opening, said notches being located and oriented within the pivoted jaw to include an outermost notch forming the outermost of said first plurality of notches and an immediately adjacent inner notch forming the outermost of the second plurality of notches, each of said outermost notches being oriented and constructed such that in the closed jaw position the head engaging surface of each of the outermost notches is perpendicular to a line from the notch which passes inwardly of the pivot axis.

2. The wrench of claim 1 wherein said fixed jaw includes a grooved wall portion within which the base portion of the pivoted jaw is pivoted, said grooved wall portion having an outer guide wall located immediately outwardly of the cooperative inner wall of the pivoted jaw and inwardly of the base portion and forming a smooth bearing wall for the drive head during the ratcheting of the wrench.

3. The ratcheting open-ended wrench of claim 1 wherein said fixed and pivoted jaw include corner-shaped notches defining the points of a standard hex-shaped head and includes a first and second groups located to engage the nut in either of two angular orientations within the drive head opening.

4. The ratcheting open-ended wrench of claim 3 wherein the wrench opening includes the notches offset by increments of 30° to permit turning of a drive head in increments of 30°.

5. A ratcheting open-ended wrench for turning of a drive head such as a nut or bolt head, comprising an operating handle having a fixed jaw fixedly secured to one end thereof, said fixed jaw extending outwardly and laterally to define one side of a drive head opening, a pivoted jaw including a base portion pivotally connected to the fixed jaw in alignment with the fixed jaw and extending laterally across the end of the handle, and extending outwardly from said base portion to the opposite side of the handle to define the base portion and opposite side of the drive head opening, said pivoted jaw being spaced from said fixed jaw to define an entrance of said drive head opening and said fixed and pivoted jaws having notched surfaces including at least one notch in each of said fixed jaw and said base portion and said opposite side of said pivoted jaw and complementing a correspondingly shaped drive head, whereby said drive head opening is oriented with said entrance essentially aligned with the operating handle and said pivot position is located to one side of said drive head opening, said fixed jaw includes a groove in one face thereof including a first portion extending in alignment with the handle to the outermost end of the fixed jaw and a lateral extension flared portion terminating in a circular bearing opening offset from the drive head opening, the portion of the bearing opening wall adjacent the drive head opening defining an encircling arm terminating in and having an extended surface at the flared portion, said arm having a circular outer wall generally having a radius centered on the center of the bearing opening, said pivoted jaw including a pivot arm portion including a circular bearing mating with the bearing opening and a connecting portion extending outwardly through said flared portion to a generally arcuate portion which extends across the groove to form the base of the head opening and then forwardly to form the opposite side of the head opening, said connecting portion including a bearing wall moving outwardly on the outer wall of the encircling arm of the fixed jaw and a surface mating with said extended surface in the closed position of the pivoted jaw to define a continuous coupling between the fixed and pivoted jaw.

6. The wrench of claim 5 wherein said groove in said fixed jaw is a machined groove, said extended surface of the arm being a flat planar surface generally on a radius of the bearing opening, and a spring means located between the pivoted jaw and the handle to continuously urge the pivoted jaw forwardly to the closed position.

7. A ratcheting open-ended wrench for turning of a drive head such as a nut or bolt head, comprising an operating handle having a fixed jaw fixedly secured to one end thereof, said fixed jaw extending outwardly and laterally to define one side of a drive head opening, a pivoted jaw including a base portion pivotally connected to the fixed jaw in alignment with the fixed jaw and extending laterally across the end of the handle and extending outwardly from said base portion to the opposite side of the handle to define the base portion and opposite side of the drive head opening, said pivoted jaw being spaced from said fixed jaw to define an entrance to said drive head opening and said fixed and pivoted jaws having notched surfaces including at least one notch in each of said fixed jaw and said base portion and said opposite side of said pivoted jaw and complementing a correspondingly shaped drive head, whereby said drive head opening is oriented with said entrance essentially aligned with the operating handle and said pivot position is located to one side of said drive head opening, the fixed jaw includes a curved stop and guide wall means spaced inwardly of the base portion of the pivoted jaw in the closed position of the pivoted jaw and outwardly of the base portion of the pivoted jaw in an open position of the pivoted jaw, said stop wall being operable to properly locate a drive head within the drive opening relative to the jaws with the pivoted jaw in said open position.

8. A ratcheting open-ended wrench for turning of a drive head such as a nut or bolthead, comprising an operating handle having a fixed jaw fixedly secured to one end thereof, said fixed jaw extending outwardly and laterally to define one side of a drive head opening, a pivoted jaw pivotally connected to the fixed jaw in alignment with the fixed jaw and extending laterally across the end of the handle and extending outwardly to the opposite side of the handle, said pivoted jaw being spaced from said fixed jaw to define an entrance to said drive head opening, said fixed jaw and said movable pivoted jaw include a plurality of substantially V-shaped adjacent notches, each notch of which consists of a pair of similar planar surfaces and defining a first plurality of interrelated equicircumferentially spaced notches and a second identical plurality of interrelated equicircumferentially spaced notches interposed in offset orientation with respect to each other to define an opening in accordance with a six-sided drive head whereby the drive head is adapted to be positioned in two alternate positions within the opening, said notches being located and oriented within the pivoted jaw to include an outermost notch forming the outermost of said first plurality of notches and an immediately adjacent inner notch forming the outermost of the second plurality of notches, each of said outermost notches being oriented and constructed such that in the closed jaw position the outermost notch surface is perpendicular to a line which passes inwardly of the pivot axis.

* * * * *